US007067773B2

(12) United States Patent
DeWitt

(10) Patent No.: US 7,067,773 B2
(45) Date of Patent: Jun. 27, 2006

(54) FOOD WARMING DEVICE AND METHODS FOR ITS MANUFACTURE

(75) Inventor: Chuck DeWitt, Conifer, CO (US)

(73) Assignee: BSI Properties, Inc., Denver, CO (US)

( * ) Notice: Subject to any disclaimer, the term of this patent is extended or adjusted under 35 U.S.C. 154(b) by 6 days.

(21) Appl. No.: 10/438,740

(22) Filed: May 14, 2003

(65) Prior Publication Data

US 2004/0226937 A1 Nov. 18, 2004

(51) Int. Cl.
*H05B 3/68* (2006.01)

(52) U.S. Cl. ..... 219/451.1; 219/462.1; 219/461.1; 219/548; 219/536; 392/407; 392/419; 392/426

(58) Field of Classification Search ..... 219/385, 219/536, 548, 448.1, 463.1, 461, 462.1, 461.1; 392/407, 411, 419, 422, 423, 424, 425, 426, 392/432, 433, 435
See application file for complete search history.

(56) References Cited

U.S. PATENT DOCUMENTS 2,844,699 A * 7/1958 Miskella ..... 392/424
3,363,090 A * 1/1968 Langley ..... 219/540
4,553,025 A * 11/1985 Raskov ..... 219/463.1
4,727,241 A * 2/1988 McWilliams ..... 219/462.1
4,892,997 A * 1/1990 McWilliams ..... 219/448.11
5,642,462 A * 6/1997 Huff ..... 392/382
6,188,836 B1 * 2/2001 Glucksman et al. ..... 392/376
2004/0151484 A1 * 8/2004 Kaplanis et al. ..... 392/422

OTHER PUBLICATIONS

Min K Document entitled, "Product Characteristics-BTU-Block Product Data", Revised Jan. 15, 2000, Doc. No. TN01601, Rev. Level 2, pp. 1-4.
K Thermal Ceramics, Material Safety Data Sheet for MSDS No. MK203, Amorphous Silica Mixture, Prepared Mar. 12, 1996, Revised on Oct. 2, 2002, pp. 1-7.
Hatch Corporation, Product Catalog entitled, "Glo-Ray Infrared Foodwarmers, World Class Holding Equipment", Printed in the U.S.A.

* cited by examiner

*Primary Examiner*—John A. Jeffery
*Assistant Examiner*—Leonid M. Fastovsky
(74) *Attorney, Agent, or Firm*—Townsend and Townsend and Crew LLP

(57) ABSTRACT

A food warming is provided with a partially open housing having an open side extending along a longitudinal length of the housing. A heating element is also provided, extending along the longitudinal length of the housing. A support member is disposed to maintain a position of the heating element at the open side of the housing. Thermally insulative material disposed within the housing insulates a surface of the housing from heat generated by the heating element.

18 Claims, 6 Drawing Sheets

FOOD WARMING DEVICE AND METHODS FOR ITS MANUFACTURE

CROSS REFERENCE TO RELATED APPLICATION

This application is related to the following concurrently filed, commonly assigned design patent application: U.S. patent application Ser. No. 29/181,803, entitled "FOOD WARMER," the entire disclosure of which is incorporated herein by reference for all purposes.

BACKGROUND OF THE INVENTION

This application relates generally to the field of food preparation. More specifically this application relates to a food warming device and methods for its manufacture.

A variety of different types of business in the food-preparation industry have a need for devices that keep food warm. For example, in a restaurant, food may be cooked at different times and needs to be kept warm for sufficient time for it to be collected by a waiter, and perhaps also while other meals for the same table are still being prepared. There is also a need to keep food warm in instances where it is made available on a food counter, or as part of a buffet or smorgasbord.

Currently, food-warming devices are provided in box-like products that use a radiant heat source. A particular drawback to such devices is that, in order for sufficient radiant energy to be provided to keep food at a prescribed temperature, the structure of the food-warming device itself becomes very hot. In many instances, the temperature of such devices is approximately 160–180° F., which is sufficiently hot that damaging burns may be caused when it is accidentally touched. At these temperatures, third-degree burns may result from exposure of as little as one second.

Current food-warming devices attempt to protect against accidental burns by installing a secondary box around the primary warmer box, sufficiently separated from the primary warmer box that it is safe to touch the secondary box. This approach has a number of drawbacks, including an increase in the size of the warming device, which results in it taking up more room on food counters and buffets, and increasing the cost of the device.

There is accordingly a general need in the art for improved food-warming devices.

BRIEF SUMMARY OF THE INVENTION

Embodiments of the invention provide a food-warming device that may be compact and have improved safety by decreasing the surface temperature of the device. Such a decreased surface temperature drastically decreases the risk of accidental burns that may result from touching the device. Moreover, the compact structure of the device makes it more versatile for use in a broader range of applications.

In one embodiment, the food warming device comprises a partially open housing having an open side extending along a longitudinal length of the housing. A heating element is also provided, extending along the longitudinal length of the housing. A support member is disposed to maintain a position of the heating element at the open side of the housing. Thermally insulative material disposed within the housing insulates a surface of the housing from heat generated by the heating element.

In some embodiments, the housing may have an arcuate cross-sectional shape and the thermally insulative material may be shaped to conform to the arcuate cross-sectional shape. The thermally insulative material may comprise, for example, microporous thermal insulation. In some instances, such microporous thermal insulation is stitched substantially only along a longitudinal length of the thermally insulative material. Also, in some instances the thermally insulative material may comprise a plurality of distinct pieces of thermally insulative material. A vapor seal may be provided to protect the thermally insulative material from exposure to moisture. The vapor seal may comprise a moisture-resistant covering disposed around the thermally insulative material. In another embodiment, the vapor seal may comprise a sealing plate that closes the open side of the housing. The sealing plate may be positioned so that the heating element is disposed exterior to the closed housing. In some instances, the sealing plate may be at least partially reflective, thereby combining its functionality as a sealing plate and as a reflector that reflects heat from the heating element away from the housing. The heating element may comprise a resistive heating element, among other types of heating elements.

The housing may have cross-sectional dimensions less than or equal to about $3.0\times3.0$ in$^2$. In some embodiments, the housing is outwardly flared at the open side. Such a configuration may facilitate insertion of the insulative material within the housing and may increase the food-warming area provided by the food-warming device.

Embodiments of the invention also provide a method for manufacturing a food-warming device. A partially open housing having an open side extending along a longitudinal length of the housing is formed. Thermally insulative material is inserted within the housing through the open side. A heating element is attached with the housing with a support member to dispose the heating element along the longitudinal length of the housing.

Forming the partially open housing may comprise forming the housing with an arcuate cross-sectional shape, in which case the method may further comprise stitching the thermally insulative material substantially only along a longitudinal length of the thermally insulative material. The method may further comprise vapor sealing the thermally insulative material to prevent exposure to moisture. Also, in some embodiments, the method may further comprise attaching a reflective plate with the housing to reflect heat from the heating element away from the housing.

BRIEF DESCRIPTION OF THE DRAWINGS

A further understanding of the nature and advantages of the present invention may be realized by reference to the remaining portions of the specification and the drawings wherein like reference numerals are used throughout the several drawings to refer to similar components.

DETAILED DESCRIPTION OF THE INVENTION

Embodiments of the invention provide food-warming devices and methods for their manufacture. The food-warming devices of the invention may be used in a wide variety of settings, including food counters, buffet displays, smorgasbord displays, and other settings where there is a need or desire to keep food warm. Furthermore, the food-warming devices of the invention may be used in conjunction with other food-protection devices, such as sneeze guards and the like. Examples of sneeze guards that may be used with the food-warming devices of the invention are provided in commonly assigned U.S. patent application Ser. Nos. 09/580,310, entitled "SNEEZE GUARDS AND METHODS FOR THEIR CONSTRUCTION AND USE," filed May 26, 2000 and 10/226,788, entitled "SNEEZE GUARD WITH LIGHTS," filed Aug. 22, 2002, the entire disclosures of both of which are incorporated herein by reference for all purposes (sometimes referred to collectively herein as "the sneeze-guard applications").

Figure 1A:
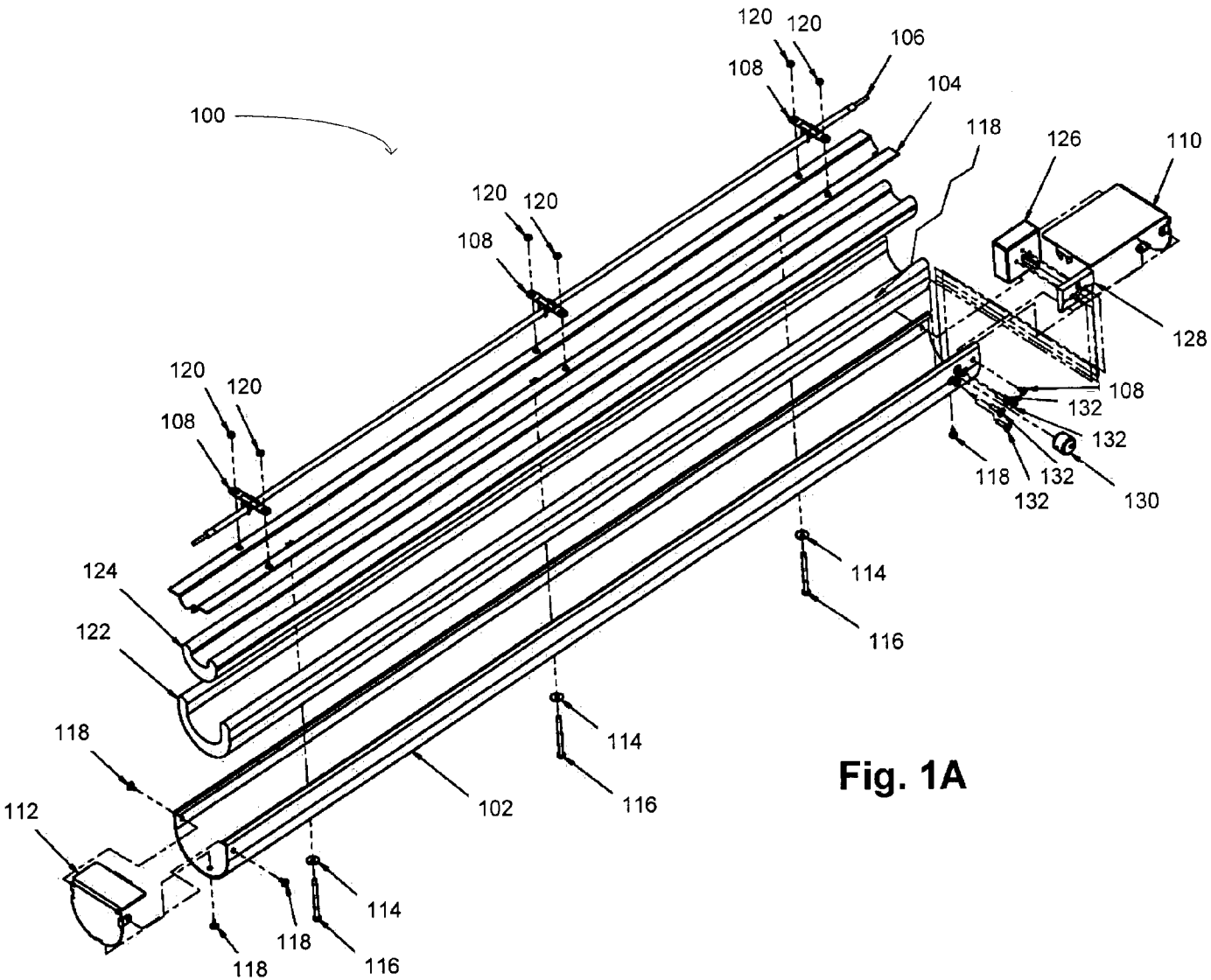
FIG. 1A provides an exploded view of a food-warming device made in accordance with an embodiment of the invention.
Figures 1B, 1C:
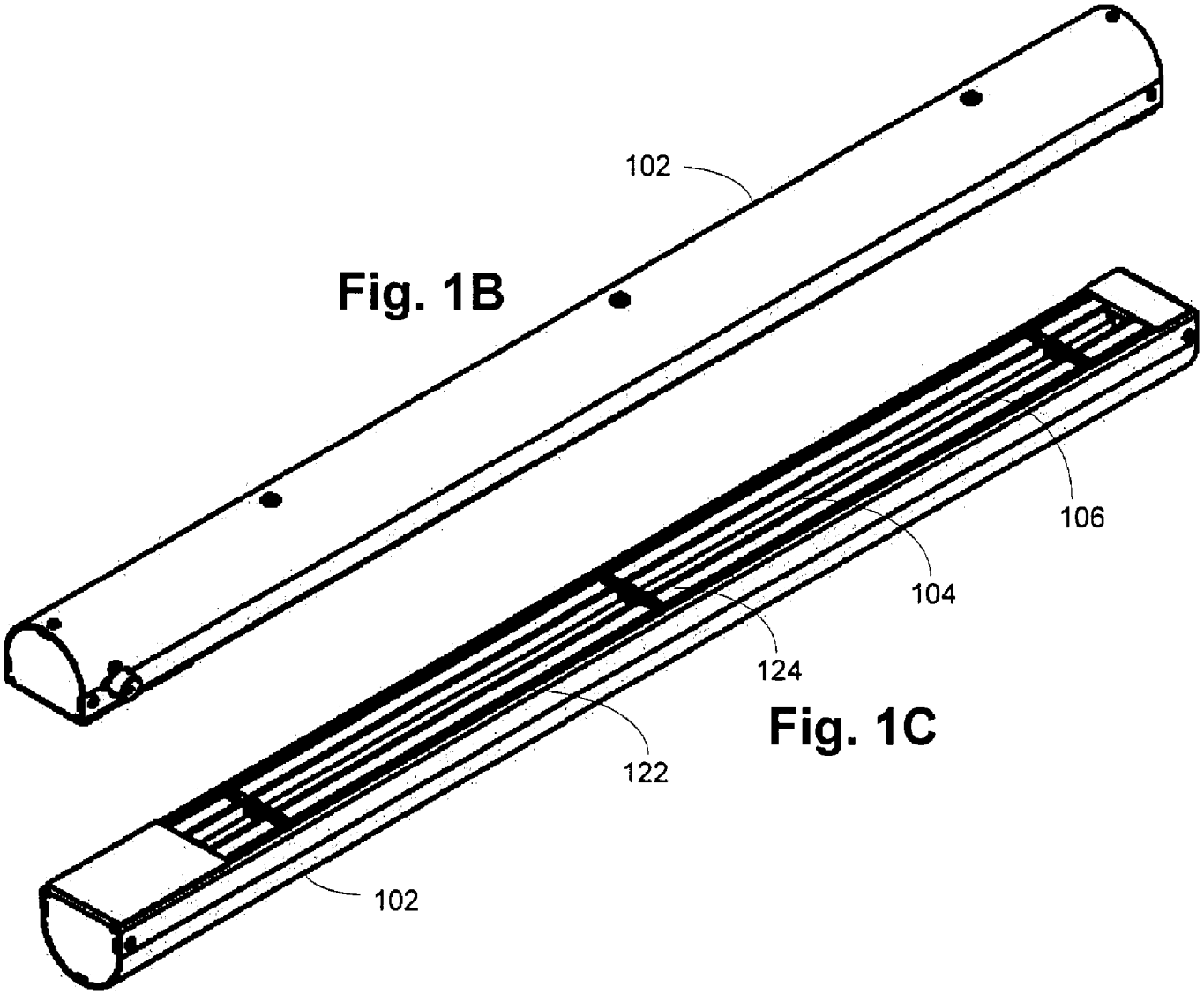
FIGS. 1B and 1C provide perspective views of the food-warming device made in accordance with the embodiment of FIG. 1A.
Figure 1D:
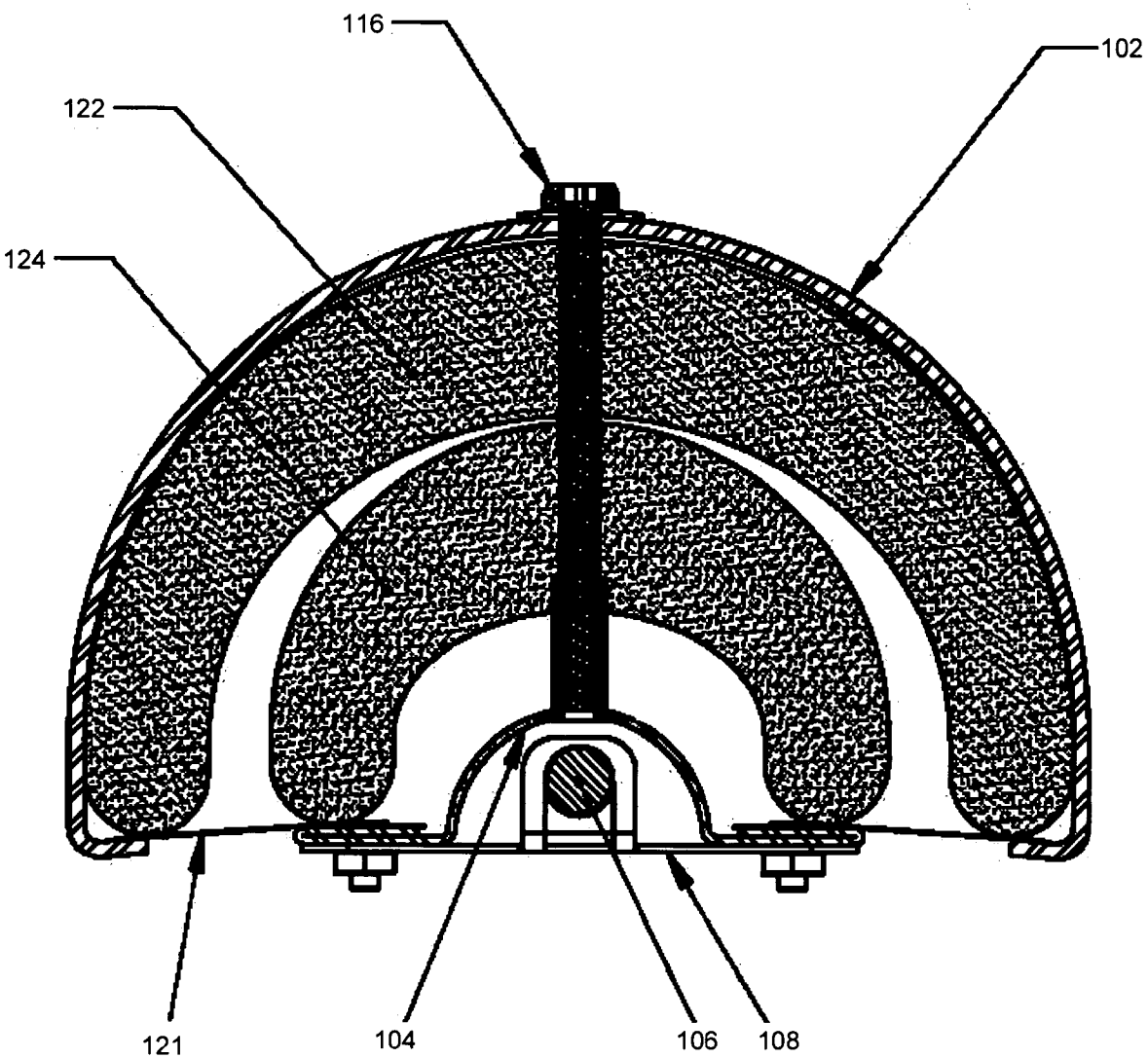
FIG. 1D provides a cross-sectional end view of the food-warming device made in accordance with the embodiment of FIG. 1A.

A first embodiment of a food-warming device in accordance with the invention is illustrated in FIGS. 1A–1D. FIG. 1A provides an exploded view of the food-warming device 100, FIGS. 1B and 1C provide perspective views of the device 100, and FIG. 1D provides a cross-sectional end view of the device 100. The food-warming device comprises a partially open housing 102 having an open side extending along a longitudinal length of the housing 102. In the illustrated embodiment, the housing 102 has an arcuate cross-sectional shape, in this instance forming an approximate C shape, although as described below other cross-sectional shapes may be used in other embodiments.

Within the housing, one or more distinct pieces of thermally insulative material may be disposed, which may advantageously be shaped to conform to the cross-sectional shape of the housing 102. In the embodiment shown in FIGS. 1A and 1D, the thermally insulative material is provided as two distinct pieces 122 and 124, each of which has an arcuate cross-sectional shape to accommodate the arcuate cross-sectional shape of the housing 102. The number of distinct pieces of thermally insulative material that are used may depend on such factors as the materials properties of the insulative material used and the ability of those materials properties to accommodate the desired dimensional characteristics of the housing 102.

For example, in some embodiments, the insulative material may comprise microporous thermal insulation, an example of which is an amorphous silica mixture marketed by Thermal Ceramics of Elkhart, Ind. under the trade name BTU Block®. Microporous thermal insulation generally has a high thermal efficiency with a low thermal conductivity and includes fine-diameter heat-resistant particles, reinforcement fibers, and high-temperature radiation blockers. The components are sized and configured to create a microporous structure that limits the number and movements of air particles to provide its thermally insulative qualities. The BTU Block® material includes 50–70 wt. % silica fume, 20–40 wt. % titanium dioxide, 0–10% of a calcium-magnesium-silicate mixture (which may include minor constituent amounts of alumina, titania, and/or zirconia), 0–5 wt. % fibrous glass filament, and 0–3 wt. % polyester fiber. The thermal conductivity of such material at 200–400° F. is approximately 0.21 (BTU in)/(hr $ft^2$ ° F.), making its thermal characteristics suitable for use in the food-warming device 100 of the invention. The stress and strain characteristics also provide sufficiently flexibility of the material for it to conform to many desired shapes without fracture.

In some embodiments, it is desirable to have the physical dimensions of the housing 102 be less than or equal to about 3.0×3.0 $in^2$. Such small physical dimensions both decrease the overall cost of materials used in the manufacture of the food-warming device 100 and improve the overall marketability of the device by permitting its unobtrusive use in a greater variety of applications. The smaller, slimmer design makes the device 100 more acceptable to purchasers, particularly in those circumstances where a larger device would detract from the appearance of the food being warmed. In one embodiment, the cross-sectional width of the housing 102 defined by the width of the open side is approximately 2.5 inches and the transverse height of the housing 102 is approximately 3.0 inches. In such instances, the arcuate portion of the housing 102 may have a small radius of curvature, i.e. approximately 1.2 inches. Even with the good flexibility characteristics of the BTU Block®, there may be a risk of fracture of the material with such small radius-of-curvature requirements. The use of a plurality of distinct pieces of the insulative material 122 and 124 at smaller individual thicknesses reduces the risk of fracture when the material is inserted to conform with the arcuate shape of the housing 102. The total thickness of insulative material used among the plurality of distinct pieces is approximately 1 inch in some embodiments.

In addition, the inventors have found that the risk of fracture may be further reduced for the applications described herein by using a variant stitching pattern for the insulative material. In particular, microporous thermal insulation is often encapsulated between two layers of high-temperature cloth, with the assembly being compressed into a uniform thickness and density, and then sewn to form the finished composite. The stitching provides structure, strength, and consistent distribution of the core material. The inventors have found, however, that square- or parallel-stitch quilting patterns impede the ability to use the insulative material in applications requiring conforming to a narrow radius of curvature over long longitudinal lengths. In one embodiment, the thermally insulative material is therefore stitched substantially only along a longitudinal length of the thermally insulative material. Such a stitching pattern avoids the quilting patterns that additionally include transverse stitching, and which interferes with the flexibility of the material in these applications. The ability to achieve such small cross-sectional dimensions for the food-warming device 100 in some embodiments is a result of a combination of using longitudinal stitching with a plurality of distinct pieces of the material. In an embodiment where two pieces of insulative material are used, the inner piece 122 may be provided as BTU Block® 1203/16 and the outer piece 124 may be provided as BTU Block® 1206/16.

While the above description has been made with respect to a particular type of insulative material used in some embodiments, it will be evident to those of skill in the art that alternative types of insulative material having similar thermal and flexibility characteristics may also be used.

Certain types of insulative material that may be used, including the microporous thermal insulation described above may be hydrophobic, in which case its thermal-insulative performance may be degraded by exposure to moisture. This is of concern in food-warming applications where the food may act as a source of steam. Accordingly, in some embodiments, a mechanism is provided for vapor sealing the thermally insulative material to protect it from exposure to moisture. Such vapor sealing may be provided in one embodiment with a moisture-resistant covering disposed around the thermally insulative material.

In another embodiment, the vapor sealing may be provided partially with a sealing plate 104 affixed with the housing 102, with epoxy, teflon-coated tape 121, or other sealing material along the longitudinal length of the housing 102 providing additional sealing. The ends of the housing 102 may be sealed at respective ends with an end plate 112 and a control unit 110 affixed with the housing 102 with brackets 126 and 128. When assembled, the control unit 110 may be operated with a control switch 130, which may generally include a toggle switch, variable switch, remote switch, and the like. FIG. 1A explicitly shows various components 114, 116, 118, and 132 for affixing such elements with the housing 102; such components may comprise any suitable means for affixing, including screws, washers, rivets, anchors, pins, tacks, connectors, fasteners, or other alternative or equivalent attachments. In one embodiment, the housing 202 is physically separated from the reflective sealing plate 104 except for the attachment elements that go through the insulative material 122 and 124. Such a configuration further improves the efficiency of the device 100 and limits the temperature of the housing 102 by minimizing thermal contact between the housing 102 and the very hot reflective sealing plate 104.

The control unit 110 is provided with an interface to a power supply and provides power to a heating element 106, which may be positioned proximate the sealing plate 104. The relative arrangement of the sealing plate 104 and heating element 106 are such that the sealing plate 104 closes the open side of the housing 102, with the heating element 106 disposed exterior to the closed housing. The attachments provide support members that maintain a position of the heating element 106 at the open side of the housing 102. For example, some of the attachment elements may comprise one or more hanger screws 116 that act as a support member. The heating element 106 may comprise any suitable heating mechanism, such as a resistive heating element, infrared-light source, ceramic heating element, and the like. Advantageously, the sealing plate 104 may be at least partially reflective. Its positioning between the heating element 106 and the insulative material 124 increases the efficiency of the food-warming device 100 by directing a greater proportion of the warming rays towards the food and reducing the amount of such warming radiation directed towards the insulative material 124. The heating element 106 may be affixed with element clips 108 coupled with hanger screws 116 and attachments 120, which may correspond to any suitable means for affixing such as described above. When assembled, the heating element 106 is interfaced with the control unit 110 so that it may be activated, deactivated, or adjusted according to desired intensity level with the control switch 130.

FIGS. 1B and 1C are perspective drawings showing the assembled food-warming device 100 respectively from a top of the device 100 and from an underside of the device 100. It is evident that the assembled device is compact, and tests performed by the inventors have confirmed that it simultaneously achieves reduced housing area and a lower average temperature rise when in operation than certain prior-art devices, without compromising desired operational characteristics. For example, the device 100 described above has approximately 62% less housing area than a comparable food-warming device marketed by Hatco under the trade name Glo-Ray®, while showing an average temperature rise from ambient of 28° F. less than the prior-art device. Touch temperatures on the food-warming device 100 made in accordance with embodiments of the invention are maintained below 140° F. under normal ranges of indoor food-service conditions, thereby increasing the necessary time of exposure for third-degree burns from about 1 second to about 30 seconds. The risk of burn injury from the device 100 is thus very significantly reduced. These improved characteristics are achieved even while the work-surface temperature provided by the device 100 remains at about 180° F. Heat released through the top of the device 100 is estimated to be about 50% less, greatly mitigating the problem of under-counter heating. Such under-counter heating is a significant problem in the prior art where warming devices are affixed under counters, particularly under counters made with heat-sensitive materials such as solid-surface shelving.

The cross-sectional end view of FIG. 1D provides an easily visible illustration of the bending of the insulative material 122 and 124 to have it conform to the arcuate shape of the housing 102. As previously noted, such tight bending may be achieved with a combination of using multiple distinct pieces and with the longitudinal stitching of the insulative material used for each piece 122 and 124.

The food-warming device 100 shown in FIGS. 1A–1D may be integrated within a variety of different types of configurations that permit its use in different circumstances. For example, an integrated unit may comprise light sources at visible wavelengths in addition to the food-warming device 100 to facilitate inspection of the food being warmed. An integrated unit may include any of a variety of different mounting arrangements, such as tubular stands, C-leg stands, T-leg stands, wall brackets, post mountings, chain-suspension mountings, under-counter mountings, and the like. Such mounting arrangements may be fixed or adjustable. In some embodiments, a plurality of food-warming devices 100 may be comprised by an integrated unit to increase the overall food-warming area that may be accommodated. In addition, in some embodiments, the integrated units may comprise a food-warming device 100 and a sneeze guard such as described in the sneeze-guard applications.

Figure 2A:
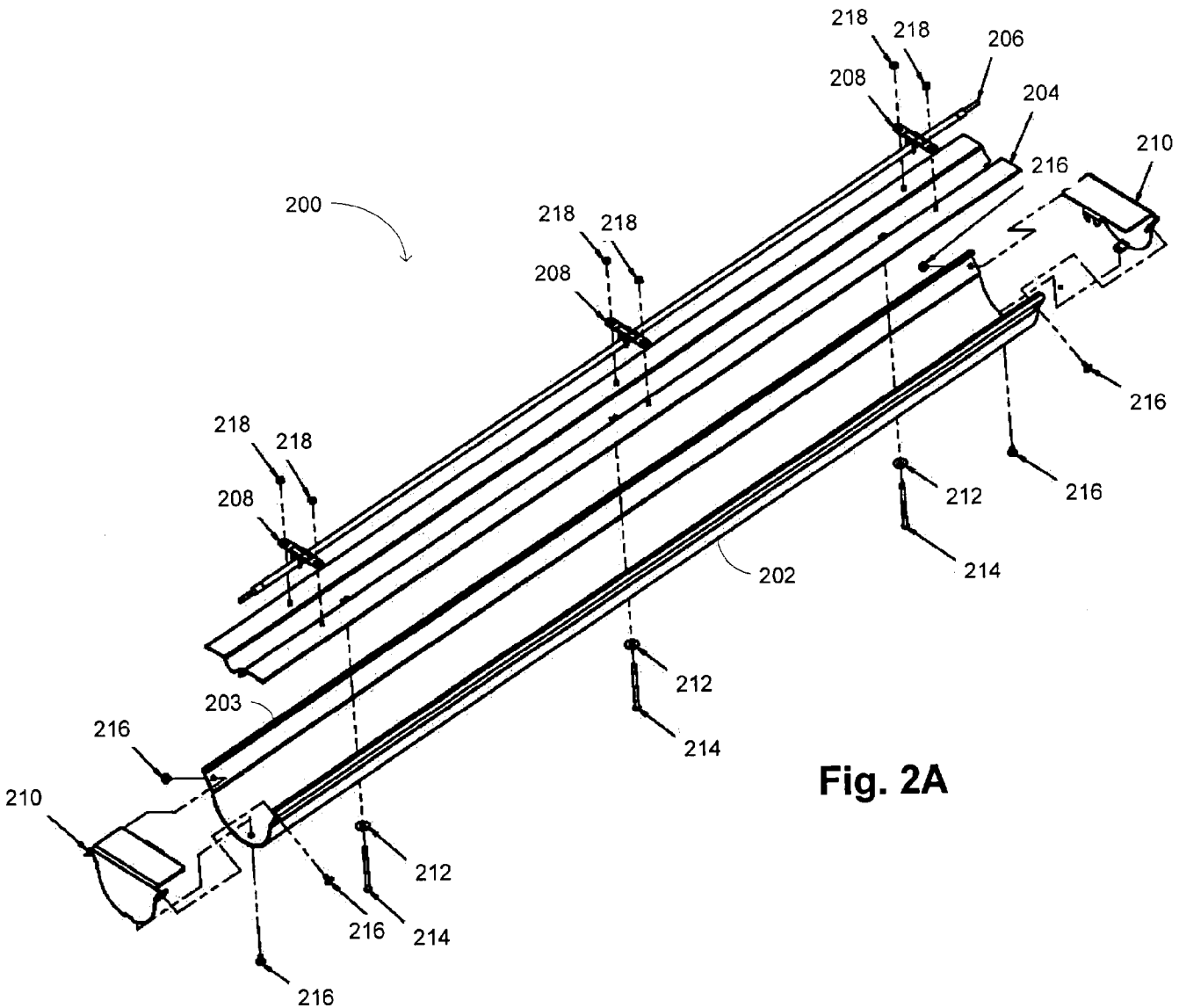
FIG. 2A provides an exploded view of a food-warming device made in accordance with another embodiment of the invention.
Figure 2B:
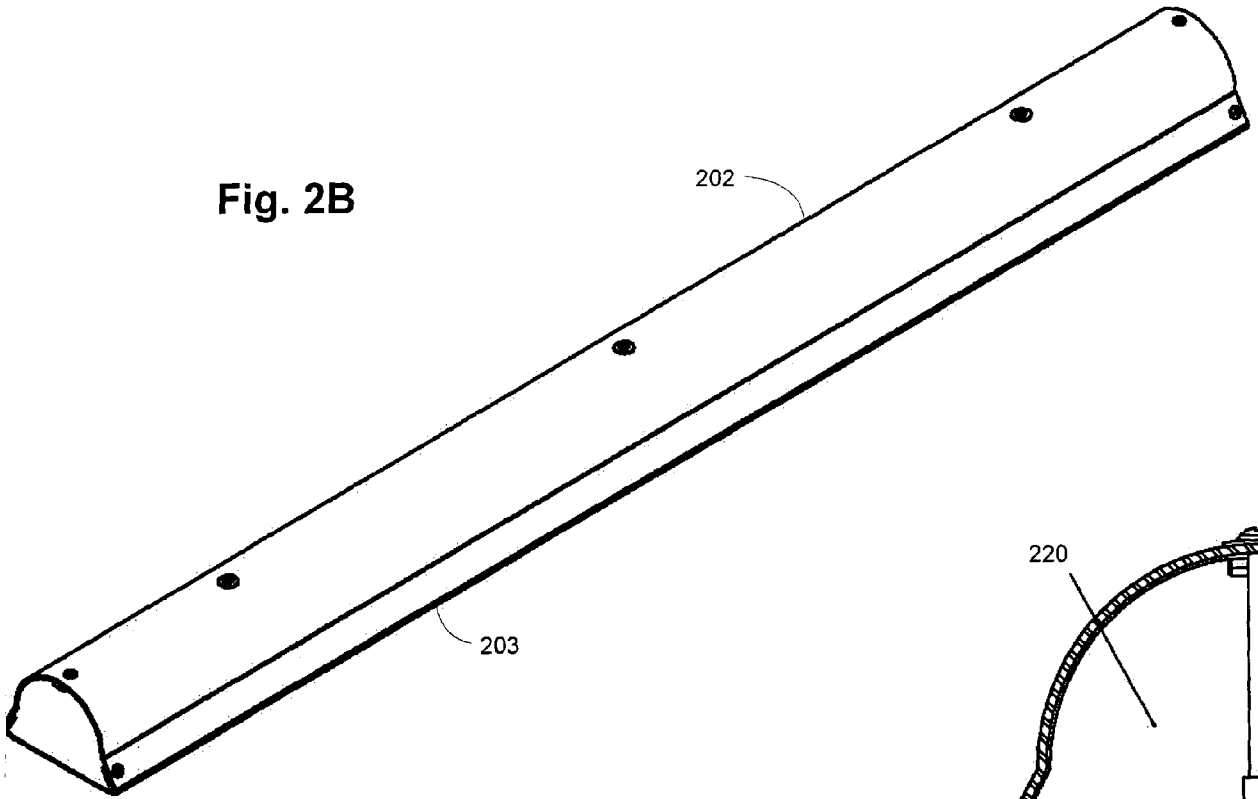
FIG. 2B provides a perspective view of the food-warming device made in accordance with the embodiment of FIG. 2A.
Figure 2C:
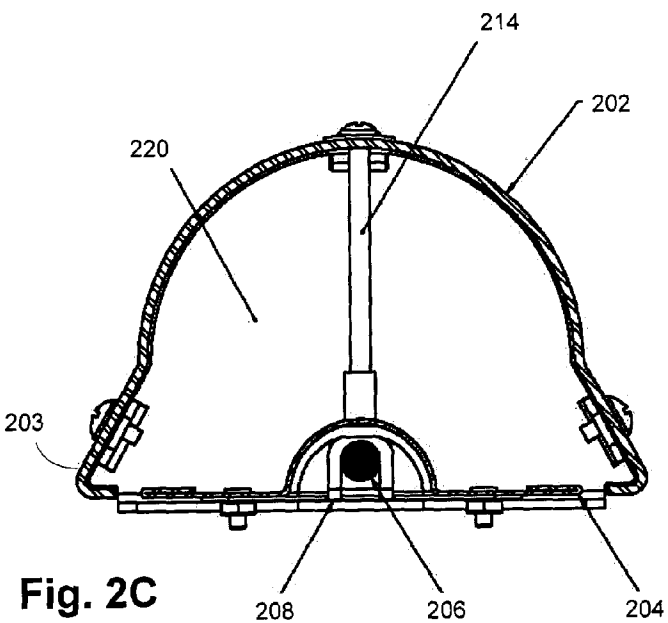
FIG. 2C provides a cross-sectional end view of the food-warming device made in accordance with the embodiment of FIG. 2A and FIG. 3 provides a flow diagram summarizing a method for manufacturing a food-warming device in accordance with an embodiment of the invention.

In embodiments where the housing 102 of the device 100 has the dimensions described above, i.e. with an approximately 2.5-inch width, the food-warming area has a width of about 20 inches when the device 100 is positioned about 1 foot from the food-warming surface. FIGS. 2A–2C illustrate an alternative embodiment in which the width of the food-warming area may be increased. FIG. 2A shows an exploded view, FIG. 2B shows a perspective view, and FIG. 2C shows a cross-sectional end view of a food-warming device 200 in accordance with such an alternative embodiment. For ease of display, the drawings in FIGS. 2A–2C do not show the insulative material, although it is generally included within the housing 202 in the same manner as described with respect to FIGS. 1A–1D. As in that embodiment, the housing 202 comprises a partially open housing having an open side extending along its longitudinal length, but in this instance further includes an outward flare 203 at its open side. As in the embodiment of FIGS. 1A–1D, a sealing plate 204 may be affixed to the housing 202 to hold the insulative material, and may be reflective to improve efficiency of the device 200. The heating element 206, which may be any suitable heating element as described above, may be disposed proximate the sealing plate 204, and the components may be affixed with suitable attachment elements 208, 212, 214, 216, and 218. For example, hanger screws 214 may act as a support member to maintain a position of the heating element 206 at the open side of the housing 202. For convenience, two end plates 210 are shown in FIG. 2A, although it will be appreciated that a control unit with a control switch may additionally be supplied to control operation of the device 200.

The flaring of the housing 202 at its longitudinal opening may be seen most clearly in the cross-sectional end view of FIG. 2C, and the perspective view of FIG. 2B shows that such flaring 203 does not adversely affect the compact nature of the device. In addition to increasing the food-warming area that may be accommodate with the device 200, the flared portion 203 of the housing 202 facilitates insertion of the insulative material into the interior space 220 of the housing 202 where it resides. In particular, the flared portion 203 reduces the amount by which the insulative material need be bent or flexed for insertion within the interior space 220, thereby further reducing the risk of its fracture.

Figure 3:
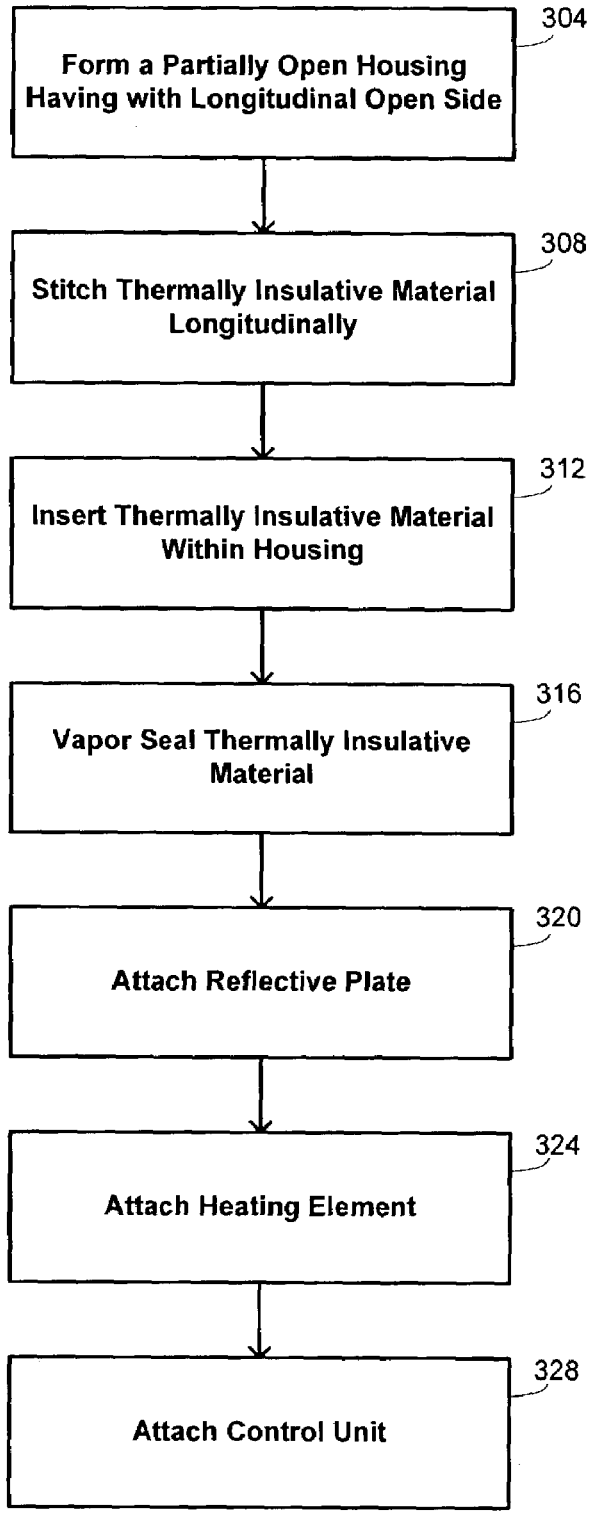

Methods for the manufacture of the food-warming devices 100 and 200 described above are summarized with the flow diagram shown in FIG. 3. While a certain order is set forth with the order of the blocks in FIG. 3, such an order reflects only a single embodiment and is not necessary in manufacturing the food-warming devices in other embodiments, which may use a different order. Furthermore, some of the steps shown in FIG. 3 may omitted in some embodiments, and additional steps may be added in other embodiments.

At block 304, a partially open housing is formed with a longitudinal open side. Such a partially open housing may have an unflared opening such as shown in FIG. 1A or may have an outwardly flared opening as shown in FIG. 2A. Insulative material, such as the microporous thermal insulation described above is stitched substantially only longitudinally at block 308. Such a stitching configuration facilitates the insertion of the thermally insulative material within the housing at block 312. Such insertion may be further facilitated in some embodiments by providing the insulative material in multiple distinct pieces or when the housing includes the outward flare at its opening. The thermally insulative material is vapor sealed at block 316. Such vapor sealing may be accomplished by vapor sealing the insulative material alone, such as by wrapping it with a moisture-resistant material, or may be accomplished with the structure of the food-warming device itself.

For example, the vapor sealing may be accomplished by using a sealing functionality of a reflective plate attached at block 320; remaining vapor gaps in the structure may be sealed with an epoxy, teflon-coated tape, or other sealing agent. The reflective plate also has the function of reflecting heat generated by a heating element attached at block 324 away from the structure of the food-warming device and towards the food-warming area, thereby further increasing the operational efficiency of the device. At block 328, a control unit is attached with the device to provide a mechanism for controlling whether it is on or off, and for controlling the intensity level of the heating element in embodiments where variable control is provided.

Having described several embodiments, it will be recognized by those of skill in the art that various modifications, alternative constructions, and equivalents may be used without departing from the spirit of the invention. Accordingly, the above description should not be taken as limiting the scope of the invention, which is defined in the following claims.

What is claimed is:

1. A food-warming device comprising:

a partially open housing having an arcuate cross-sectional shape and an open side extending along a longitudinal length of the housing;

a heating element extending along the longitudinal length of the housing;

a support member disposed to maintain a position of the heating element at the open side of the housing;

a first distinct piece of thermally insulative material that comprises microporous thermal insulation disposed within the housing to insulate a surface of the housing from heat generated by the heating element, the first distinct piece extending alone the longitudinal length of the housing and shaped to conform to the arcuate cross-sectional shape;

a second distinct piece of thermally insulative material that comprises microporous thermal insulation extending alone the longitudinal length of the first piece, wherein at least a part of the second distinct piece is disposed within an area defined by the arcuate shape of the first piece; and a vapor seal to protect the first piece and the second piece of thermally insulative material from exposure to moisture.

2. The food-warming device recited in claim 1 wherein the thermally insulative material is stitched substantially only along a longitudinal length of the thermally insulative material.

3. The food-warming device recited in claim 1 wherein the thermally insulative material comprises a plurality of distinct pieces of thermally insulative material.

4. The food-warming device recited in claim 1 wherein the vapor seal comprises a sealing plate that closes the open side of the housing.

5. The food-warming device recited in claim 4 wherein the sealing plate is shaped and positioned such that the heating element is exterior to the closed housing.

6. The food-warming device recited in claim 5 wherein the sealing plate is at least partially reflective.

7. The food-warming device recited in claim 1 wherein the vapor seal comprises a moisture-resistant covering disposed around the thermally insulative material.

8. The food-warming device recited in claim 1 further comprising a reflective plate shaped and positioned to reflect heat from the heating element away from the housing.

9. The food-warming device recited in claim 8 wherein the vapor seal comprises the reflective plate.

10. The food-warming device recited in claim 1 wherein the housing has cross-sectional dimensions less than or equal to about $3.0 \times 3.0$ in$^2$.

11. The food-warming device recited in claim 1 wherein the heating element comprises a resistive heating element.

12. The food-warming device recited in claim 1 wherein the housing is outwardly flared at the open side.

13. A method for manufacturing a food-warming device, the method comprising:

forming a partially open housing having an arcuate cross-sectional shape and an open side extending along a longitudinal length of the housing;

inserting a first distinct piece of thermally insulative material that comprises microporous thermal insulation within the housing through the open side, the first distinct piece extending alone the longitudinal length of the housing and shaped to conform to the arcuate cross-sectional shape;

inserting a second distinct piece of thermally insulative material that comprises microporous thermal insulation extending alone the longitudinal length of the first piece, wherein at least a part of the second distinct piece is disposed within an area defined by the arcuate shape of the first piece;

attaching a heating element with the housing through a support member to dispose the heating element along the longitudinal length of the housing; and vapor sealing the first piece and the second piece of thermally insulative material to prevent exposure to moisture.

14. The method recited in claim 13 further comprising stitching the thermally insulative material substantially only along a longitudinal length of the thermally insulative material.

15. The method recited in claim 13 further comprising attaching a reflective plate with the housing to reflect heat from the heating element away from the housing.

16. A food-warming device comprising:

a partially open housing having an arcuate cross-sectional shape and an open side extending along a longitudinal length of the housing;

means for heating extending along the longitudinal length of the housing;

means for supporting the means for heating at the open side of the housing;

a first distinct piece of thermally insulative material that comprises microporous thermal insulation disposed within the housing to insulate a surface of the housing from heat generated by the means for heating, the first distinct piece extending along the longitudinal length of the housing and shaped to conform to the arcuate cross-sectional shape;

a second distinct piece of thermally insulative material that comprises microporous thermal insulation extending alone the longitudinal length of the first piece, wherein at least a part of the second distinct piece is disposed within an area defined by the arcuate shape of the first piece; and means for vapor sealing the means for thermally insulating.

17. The food-warming device recited in claim 16 further comprising means for reflecting heat generated by the means for heating from the housing.

18. A food-warming device comprising:

a partially open housing having an arcuate cross-sectional shape and an open side extending along a longitudinal length of the housing;

a heating element extending along the longitudinal length of the housing;

a support member disposed to maintain a position of the heating element at the open side of the housing;

a first distinct piece of thermally insulative material that comprises microporous thermal insulation disposed within the housing to insulate a surface of the housing from heat generated by the heating element, the first distinct piece extending along the longitudinal length of the housing and shaped to conform to the arcuate cross-sectional shape; and a second distinct piece of thermally insulative material that comprises microporous thermal insulation extending along the longitudinal length of the first piece, wherein at least a part of the second distinct piece is disposed within an area defined by the arcuate shape of the first piece, wherein the first piece and the second piece of thermally insulative material are each stitched substantially only along a longitudinal length of the thermally insulative material.

* * * * *

UNITED STATES PATENT AND TRADEMARK OFFICE

CERTIFICATE OF CORRECTION

PATENT NO. : 7,067,773 B1
APPLICATION NO. : 10/438740
DATED : June 27, 2006
INVENTOR(S) : DeWitt It is certified that error appears in the above-identified patent and that said Letters Patent is hereby corrected as shown below:

Claim 1 at column 8, line 21, the word “alone” should read --along--.
Claim 1 at column 8, line 26, the word “alone” should read --along--.
Claim 13 at column 9, line 4, the word “alone” should read --along--.
Claim 13, at column 9, line 9, the word “alone” should read --along--.
Claim 16, at column 10, line 3, the word “alone” should read --along--.

Signed and Sealed this

Fifth Day of September, 2006

JON W. DUDAS
*Director of the United States Patent and Trademark Office*